US010718495B2

(12) United States Patent
Muntean

(10) Patent No.: US 10,718,495 B2
(45) Date of Patent: Jul. 21, 2020

(54) SCULPTURE FOR CASTING SHADOWS

(71) Applicant: John V. Muntean, Riverside, IL (US)

(72) Inventor: John V. Muntean, Riverside, IL (US)

( * ) Notice: Subject to any disclaimer, the term of this patent is extended or adjusted under 35 U.S.C. 154(b) by 46 days.

(21) Appl. No.: 15/879,859

(22) Filed: Jan. 25, 2018

(65) Prior Publication Data

US 2019/0226661 A1 Jul. 25, 2019

(51) Int. Cl.

| | |
|---|---|
| ***F21V 14/08*** | (2006.01) |
| ***F21V 11/18*** | (2006.01) |
| ***B44F 1/00*** | (2006.01) |
| ***F21V 11/00*** | (2015.01) |
| *B44C 3/06* | (2006.01) |

(52) U.S. Cl.

CPC ..... *F21V 14/08* (2013.01); *B44F 1/00* (2013.01); *F21V 11/00* (2013.01); *F21V 11/183* (2013.01); *B44C 3/06* (2013.01)

(58) Field of Classification Search

CPC ..... Y10S 362/806; F21V 1/10; B44F 1/10
USPC ..... 362/124, 127, 351, 458, 806, 808
See application file for complete search history.

(56) References Cited

U.S. PATENT DOCUMENTS 4,972,305 A * 11/1990 Blackburn ..... G09F 19/18 362/234

OTHER PUBLICATIONS www.jvmuntean.com (Year: 2016).*
https://io9.gizmodo.com/incredible-3d-shadow-sculpture-depicts-the-evolution-of-5890492 (Year: 2012).*
https://youtube.com/watch?v=W6aixZ-6pVk (Year: 2015).*
https://www.youtube.com/watch?v=4QKVWFuRQBs (Year: 2016).*
https://www.youtube.com/user/jvmuntean/videos?disable_polymer=1 (Year: 2016).*
https://www.youtube.com/watch?v=VJp6wbHk02s (Year: 2016).*
https://www.youtube.com/watch?v=gcQu_ZHLrN8 (Year: 2016).*

* cited by examiner

*Primary Examiner* — William J Carter
(74) *Attorney, Agent, or Firm* — Joseph A. Fuchs; Greensfelder, Hemker & Gale, P.C.

(57) ABSTRACT

The present invention provides a sculpture bound within the volume of a polyhedron that when, rotated about an axis of rotation and positioned in the path of a directed light source, cast shadows of a predetermined and desired form onto a surface.

20 Claims, 13 Drawing Sheets

FIG. 9
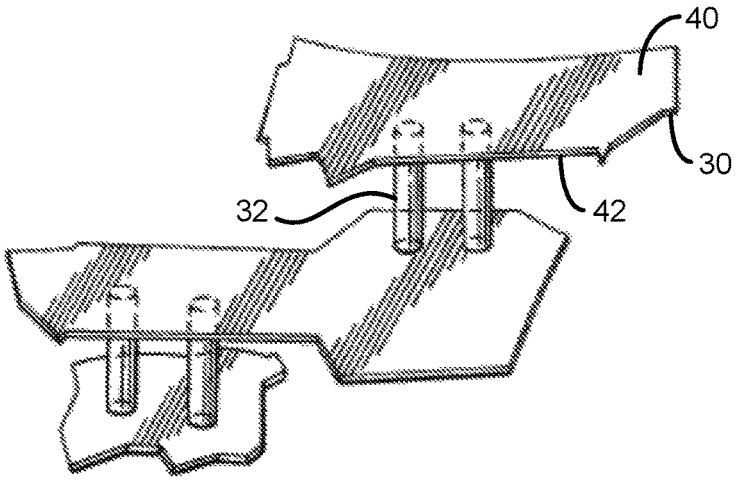
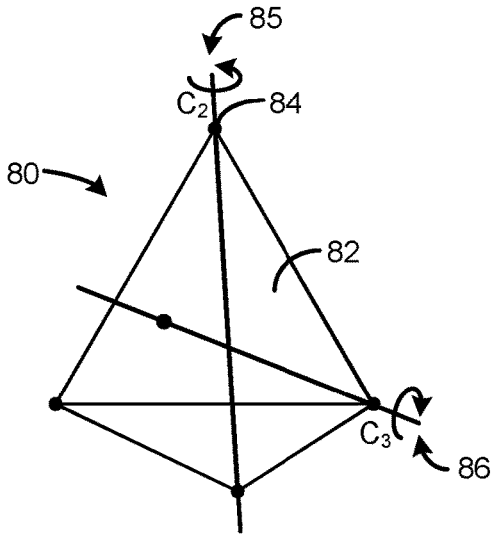
FIG. 10
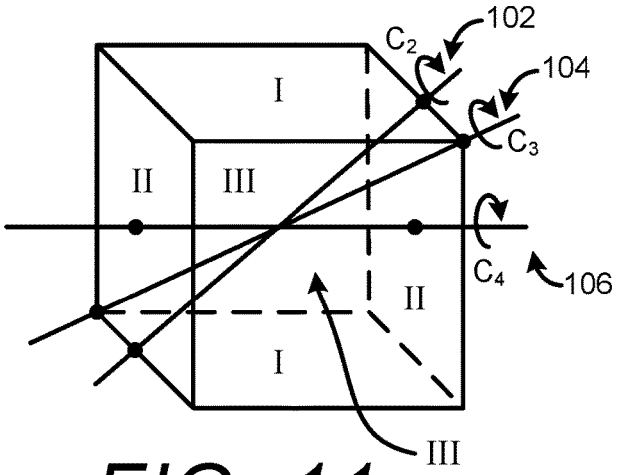
FIG. 11

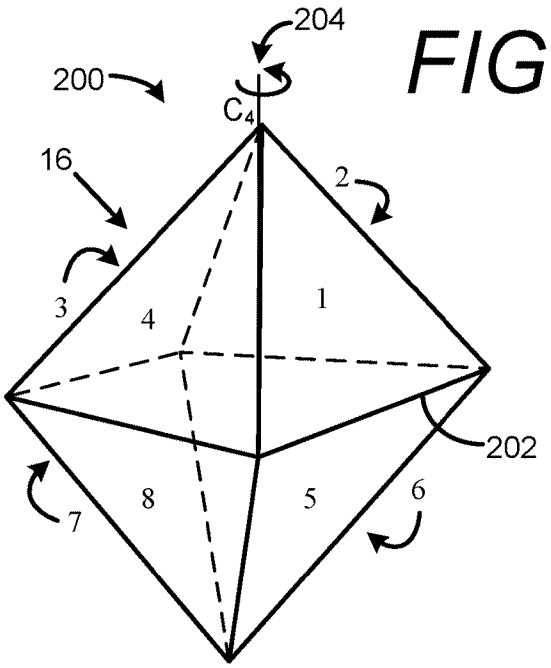
FIG. 12
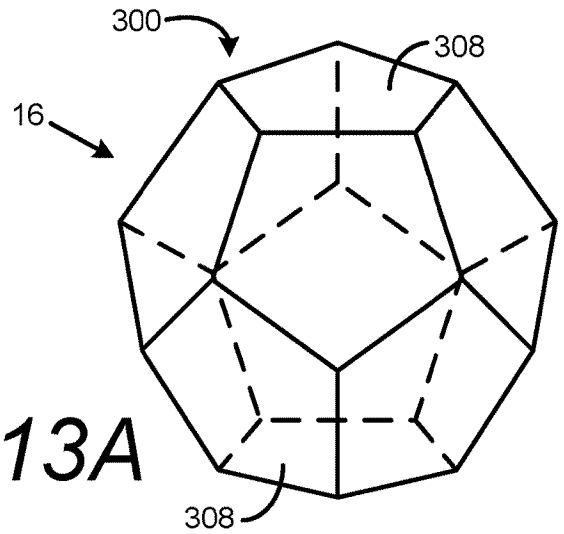
FIG. 13A
FIG. 13B
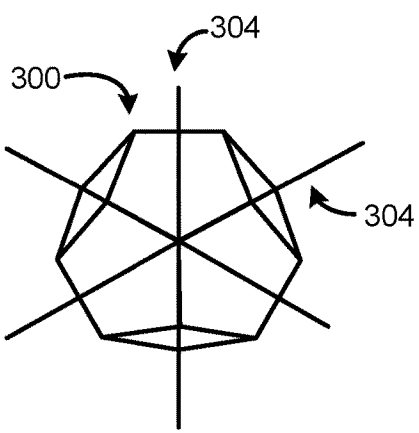
FIG. 13C
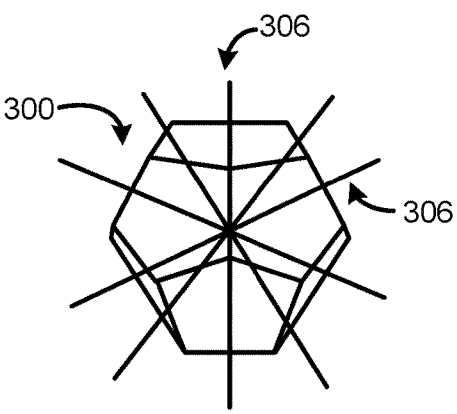
FIG. 13D

| | |
|---|---|
| 1000 | Determine the number of images to be cast by the sculpture |
| 1002 | Make a sketch of the number of images |
| 1004 | Select a suitable opaque solid to bound the sculpture |
| 1006 | Enter the images into the animation or CAD software |
| 1008 | Using the software determine the material that must be removed from the opaque solid to cast the first shadow |
| 1010 | Repeat step 1008 for each number of shadows to be cast |
| 1012 | Ensure that each shadow can be cast |
| 1014 | Determine the shapes of each plate, the number of layers, the spacing between the plates |
| 1016 | Form the plates into the desired shape |
| 1018 | Connect the plates together with the spacers |
| 1020 | Mount the sculpture for rotational motion about an axis of rotation and through a light path and determine whether the number of shadows have the desired form. |

FIG. 18

SCULPTURE FOR CASTING SHADOWS

FIELD OF THE INVENTION

The present invention provides a sculpture for casting numerous different shadows or silhouettes of a desired shape when the sculpture is rotated about an axis and into a light path of a directed light source and more particularly a sculpture bound within an opaque polyhedron having a plurality of pairs of registered faces. Each pair of registered faces, when positioned in the light path, will cast a shadow of a predetermined and desired shape.

DESCRIPTION OF THE PRIOR ART

Shadow art has been practiced for many years and involves positioning an opaque object or objects in a light path to cast shadows of a desired shape. One example appears on the cover of Douglas Hofstadter's 1979 book, *Gödel, Escher, Bach: An Eternal Golden Braid*. Hofstadter showed the three letters: G, E, and B cut into the orthogonal faces of two cubes.

The inventor of the present application has created numerous sculptures from Lego plates, wood, clay, plastic, and paper for casting three different shadows. One such sculpture was bound within the volume of a cube and was mounted on an axle at ~54.74° to an adjacent edge of the cube. The so-called "magic angle" is the identity function (X=Y=Z), an irrational number, and will interchange the XY, XZ, and YZ planes of a cube. This angle was inspired by the use of the magic angle sample spinning in NMR spectroscopy. One limitation in using Lego plates is they are available only in specific sizes so the resolution of a shadow cast by such blocks is limited.

The present invention provides creating sculptures bound within a polyhedron using numerous plates connected together to form parallel layers with gaps between the layers. Using this technique, shadows of greater resolution or detail can be cast by such layered sculpture. Additionally, less material is required resulting in a lighter weight sculpture.

SUMMARY OF THE INVENTION

The present invention provides a sculpture bound within a volume of a polyhedron having a first plurality of pairs of registered faces. The sculpture has a first plurality of plates connected together in parallel spaced relationship to form a first number of layers with gaps between adjacent plates. The first plurality of plates has surfaces extending transverse to a first pair of registered faces of the first plurality of pairs of registered faces and arranged to cast a first shadow of a predetermined shape when the sculpture is positioned at a first angle of rotation about an axis and within a light path from a source of light directed at an oblique angle to the surfaces. The sculpture has a second plurality of plates connected together in parallel spaced relationship to form a second number of layers with gaps between adjacent plates. The second plurality of plates has surfaces extending transverse to a second pair of registered faces of the first plurality of registered faces and arranged to cast a second shadow of a predetermined shape when the sculpture is positioned at a second angle of rotation about the axis different from the first angle and in the light path directed at an oblique angle to the surfaces. The sculpture has an optional axle connected to the sculpture with the axis of rotation extending through the axle. Rotation of the axle successively brings each pair of registered faces of the first plurality of pairs of registered faces into alignment with the light path.

The present invention also provides a system for projecting multiple shadows on to a surface including a sculpture and a light source. The present invention also provides a method for forming a sculpture, a method for suspending the sculpture for rotation about an axis of rotation, and a method of projecting several shadows onto a surface using a rotating sculpture and a light source. The present invention also contemplates rotating the light source about a fixed-position sculpture.

BRIEF DESCRIPTION OF THE DRAWINGS

To understand the present invention, it will now be described by way of example, with reference to the accompanying drawings and attachments in which:

FIG. 9 is a plan view of a single layer of the sculpture.

FIG. 10 is a perspective view of a tetrahedron showing axes of symmetry.

FIG. 11 is a perspective view of a cube showing axes of symmetry.

FIG. 12 is a perspective view of an octahedron showing axes of symmetry.

FIGS. 13A-D are perspective views of a dodecahedron and showing axes of symmetry.

FIG. 18 is a flowchart of a method for forming a sculpture of the present invention.

DETAILED DESCRIPTION

Figure 1A:
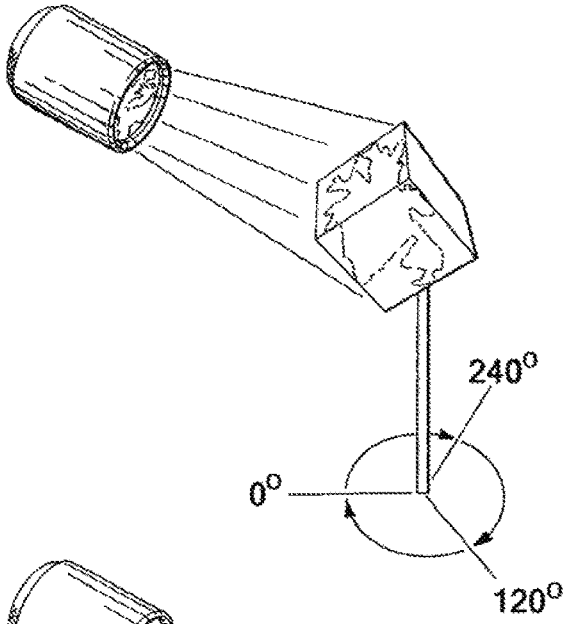
FIGS. 1A, B, C are perspective views of a sculpture mounted for rotational movement about an axis of rotation to cast three shadows onto a surface.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a sculpture bound within the volume of a polyhedron that when, rotated about an axis of rotation and positioned in the path of a directed light source, cast shadows of a predetermined and desired form onto a surface. A single sculpture can cast numerous different shadows of a predetermined form from 2 shadows to about 20 shadows, and most preferably from about 2 shadows to about 10 shadows, or any range or combination of ranges therein. The surface upon which the shadows are cast can be a wall, screen, or other man-made surface, or an eyeball of a viewer. It should be understood the axle is optional. It is possible for a viewer of the sculpture to move about the stationary sculpture and view it from different vantage points to see the shadows. The sculpture 10 can be rotated at a desired speed to achieve a desired effect. In one form of the invention, the shadows will be different from one another. In another form of the invention, the display of successive shadows will create the illusion of movement like a video or motion picture, and will suggest a story or connective idea to the viewer.

Figure 1B:
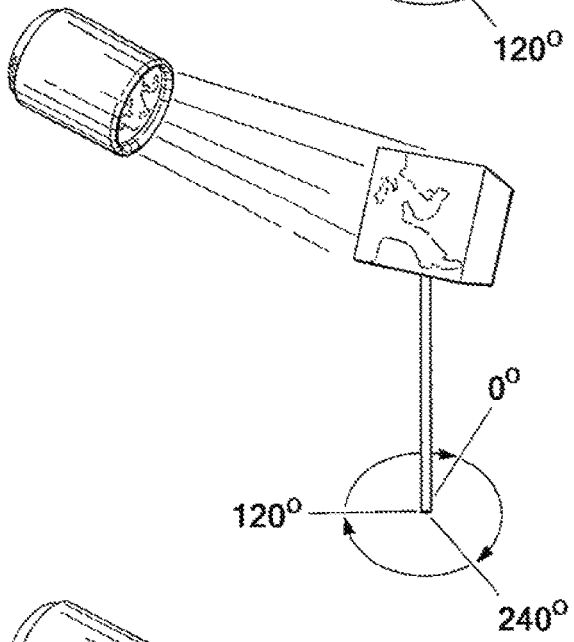
Figure 1C:
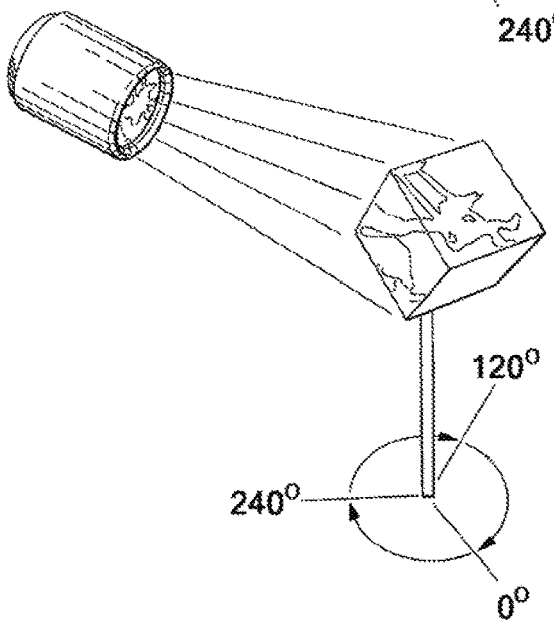

FIGS. 1A-1C shows a sculpture 10 bound within the volume of a polyhedron, more preferably a parallelpiped solid, and most preferably a cube (FIG. 11). The sculptor 10 is shown mounted for rotation about an optional axle 12 which defines an axis of rotation 14. As can be better seen in FIG. 11, the axis 14 is the diagonal of the cube and defines a 3-fold axis of rotation 104. Upon rotation of the sculpture through three successive 120° rotations each pair of registered faces of the cube are brought into alignment with the light path 16 to cast three shadows 20 on a surface 22. While a cube is shown as one preferred polyhedron, numerous other polyhedra can be used. Suitable polyhedra include platonic solids, Archimedean solids, Johnson solids, parallelpipeds, prisms, and antiprisms. The sculpture is mounted to the axle 12 to form an angle α, which in this case, is approximately 54.7 degrees to an adjacent edge 19.

Figure 14:
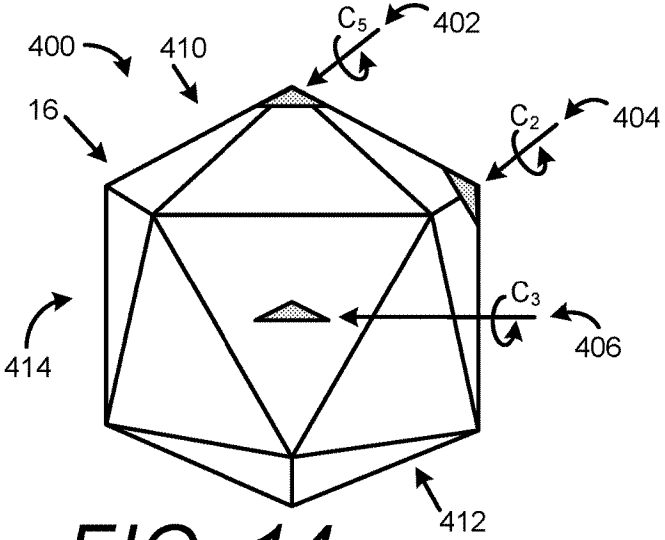
FIG. 14 is a perspective view of an icosahedron with axes of symmetry.

Platonic solids are regular, convex polyhedra constructed from congruent (same shape and size), regular (all angles equal and all sides are equal) polygonal faces with the same number of faces meeting at each vertex. Platonic solids include tetrahedrons 80 (FIG. 10), cubes 100 (FIG. 11), octahedrons 200 (FIG. 12), dodecahedrons 300 (FIG. 13), and icosahedrons 400 (FIG. 14). FIG. 10 shows the tetrahedron 80 having four triangular faces 82, four vertices 84, a 2-fold axis of symmetry 85, and a 3-fold axis of symmetry 86. An n-fold axis of rotation means that when an object is rotated about the axis by 360°/n the object will be the same. Thus, a 2-fold axis requires a 180° rotation, a 3-fold axis 120°, 4-fold axis requires 90°, a 5-fold axis requires 720, and a 6-fold axis requires 60°. The tetrahedron 80 when mounted for rotation about the 2-fold axis 85 will position two registered pair of faces into the light path and upon a 180° rotation will rotate the other two faces into the light path 16 to cast two different shadows.

The cube 100 is a square prism having six faces, eight vertices, and three pairs of registered faces I, II, and III. FIG. 11 show a 2-fold axis 102, a 3-fold axis 104, and a 4-fold axis 106. Mounting the cube for rotation about the 3-fold axis 106, as is shown in FIGS. 1A-IC, allows for rotating each pair of registered faces I, II III through the light path upon successive 120° rotations to cast three shadows.

The octahedron 200 has eight faces (numbered), six vertices, and four pairs of registered faces. In one preferred form of the invention, when the octahedron 200 is mounted for rotation about the axis 204, the registered faces will be on opposite sides of an equatorial square 202, and will include pairs 1 and 7, 2 and 8, 3 and 5, and, 4 and 6. Each successive rotation of 90° about the 4-fold axis 204 will bring a new pair of registered faces into the light path 16. Thus, four shadows can be cast by using the octahedron.

The dodecahedron 300 (FIG. 10D) has 12 pentagonal faces and six pairs of registered faces. The dodecahedron has three types of axes of symmetry, a two-fold axis 302 (FIG. 13B) (two of 15 shown), a three-fold axis 304 (FIG. 13C) (four of ten shown), and, a five-fold axis 306 (FIG. 308) (five of six shown). Rotating the dodecahedron 300 about the five-fold axis will allow for successively positioning five pairs of registered faces through the light path 16 but not the two polar faces 308. The two polar faces 308 can be rotated into the light path by a 120° rotation about one of the three-fold axes 304. A mechanism is described below to switch the axis of rotation from a first axis to a second axis so that all of the pairs of registered faces can be rotated through a single light path 16 and cast successive shadows onto a single surface.

The icosahedron 400 (FIG. 14) has twenty triangular faces, 30 edges, twelve vertices and ten pairs of registered faces. The icosahedron 400 has three types of axes of rotation, a five-fold axis 402, a two-fold axis 404, and a three-fold axis 406. The icosahedron 400 has 10 triangular faces (five registered pairs) in two polar regions 410, 412, and ten faces in an equatorial region 414. The polar faces can be rotated through the light path 16 by five successive 72° rotations about the five-fold axis 402. By rotating the icosahedron 120° about the 3-fold axis 406 disposes the equatorial faces 414 into the polar regions about the 5-fold axis 402. Five additional successive 72° rotations about the five-fold axis 402 brings all ten faces (five registered pairs) through the light path 16 to cast 10 shadows.

Figure 15:
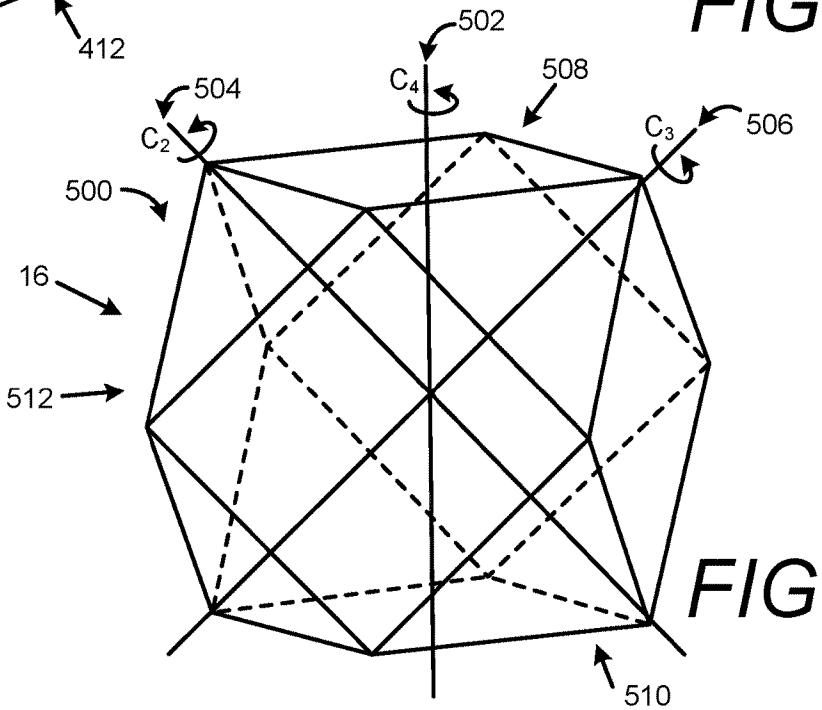
FIG. 15 is a perspective view of a cuboctahedron.

Archimedean solids include 13 solids that are semi-regular convex polyhedra composed of regular polygons meeting in identical vertices and excluding prisms and antiprisms. The Archimedean solids include the five platonic solids described above. FIG. 15 shows one example—a cuboctahedron 500 having eight triangular faces and six square faces, twelve identical vertices with two triangles and two squares meeting at each vertex., and seven registered pairs of faces. The cuboctahedron 500 has a 4-fold axis 502, a 2-fold axis 504, and a 3-fold axis 506. The cuboctahedron 500 can be oriented, as shown, with the square faces in the polar regions 508, 510 and the triangular faces in the equatorial region 512. All pairs of registered faces can be moved into the light path 16 by four 90° rotations about the 4-fold axis 502 to bring the eight triangular faces into the light path and three 120° rotations about the 3-fold axis 506 to bring the six square faces into the light path 16. The rotation about these two axes can be done in any order. The other Archimedean solids are well known to those of ordinary skill in the art.

Figure 16:
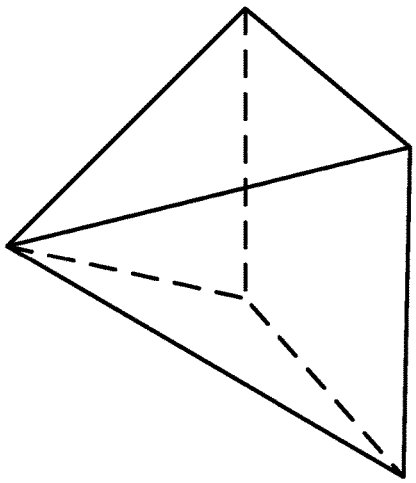
FIG. 16 is a perspective view of a square-based prism.

Johnson solids are convex polyhedra which are not uniform (not a Platonic solid, Archimedean solid, prism or antiprism). A square-based prism 600 (FIG. 16) is one example of a Johnson solid and has one square shaped face and four equilateral triangle faces. Faces of a Johnson solid have 3, 4, 5, 6, 8 or 10 sides.

Parallelpiped solids are those having six parallelograms and include cubes (FIG. 11), rectangular cuboids, and rhomboids. Parallelpiped solids have six faces, eight vertices and four pairs of registered faces.

Figure 17A:
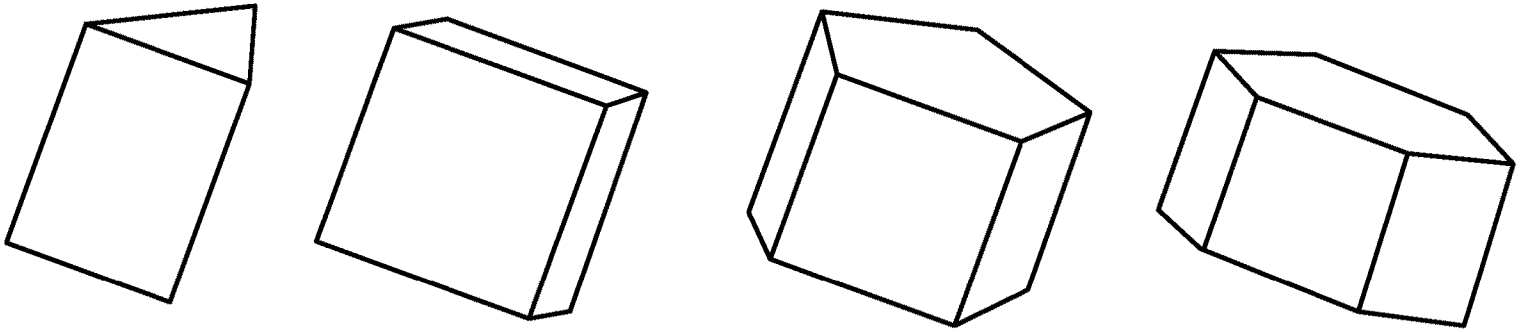
FIG. 17A is a perspective view of several prisms.

Prisms include those solids having two parallel copies of an n-faced polygon having from 3-10 vertices with each vertex connected together along parallel lines that form a generally square or rectangular shaped face, depending on the distance the faces are spaced from one another. FIG. 17A shows prisms for n=3 to 6.

Figure 17B:
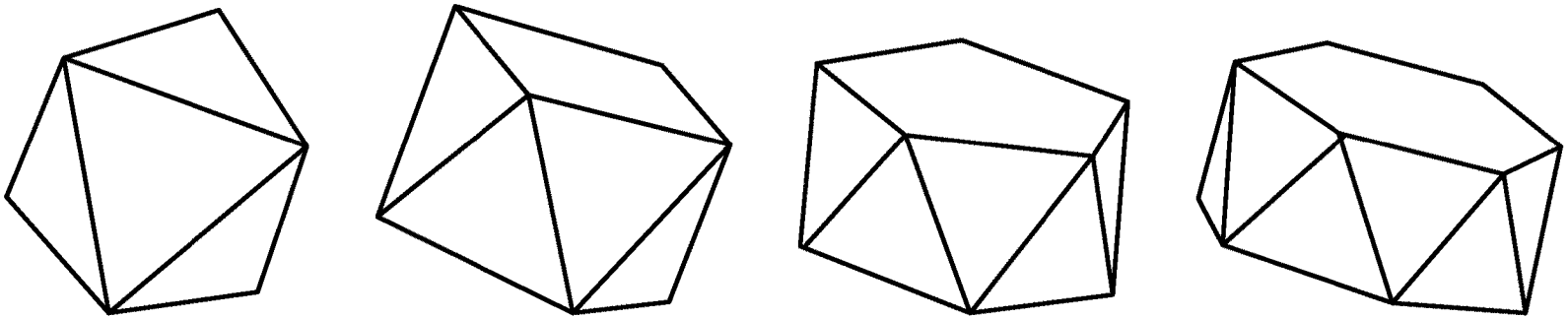
FIG. 17B is a perspective view of several antiprisms.

Antiprisms include those solids having two parallel copies of an n-sided polygon having from 3-10 sides connected by 2n alternating bands of triangles. FIG. 17B shows antiprisms for n=2 to 6.

FIGS. 6-10 show the sculpture 10 fabricated from a plurality of plates 30 connected by spacers 32 in parallel spaced relationship to define gaps 34 between adjacent plates. The plurality of plates form a multilayered structure.

The plates shown each has an upper surface 40 and a lower surface 42, and the upper surface is generally planar having a straight line cross-sectional shape. The lower surface can be planar or have a different cross-sectional shape. The plates 30 can also have an undulating surface, a textured surface, or other non-flat surface. An undulating surface can have a cross-sectional shape of a curved line, a sine wave, a saw tooth, and the like. The textured surface can have a plurality of protuberances and or indentations that affect the light reflecting quality of the surface. The protuberances and indentations can take on a variety of shapes in cross section, such as circular, semi-circular, square, rectangular, triangular, polygonal, and oval to name a few. The protuberances and indentations can cover the entire surface area of the plate or only portions thereof. The protuberances and indentations can also form a pattern on the surface. The protuberances can also take on various sizes. The plates can be formed from a variety of materials including metal, metal alloys, plastics, glass, cloth, paperboard, paper, wood, composites, cork, and other materials well known to those of ordinary skill in the art Most preferably, the plates will be stainless steel.

The spacers can also be fabricated from a variety of materials and take on a variety of shapes. Most preferably, the spacers can be made from the same types of materials from which the plates can be fabricated but do not have to be the same material as the plates. The spacers can be connected to the plates using a variety of techniques such as welding, using fasteners, using adhesives, interference fits, snap fits, and the like. Welding includes a wide variety of techniques for joining metals to metals, plastics to plastics, and plastics to metals. Welding includes MIG (Metal Inert Gas), arc, TIG (Tungsten Inert Gas), acetylene torch, MAP torch, propane torch, conduction, induction, and vibration among other techniques well known to those of ordinary skill in the art. Most preferably the spacers are generally cylindrical, made from stainless steel and are connected to the plates by arc welding.

FIG. 9 shows the plates of a single layer. The plates can have a variety of shapes to cast a portion of a shadow and is determined using software and methods described below. The plates can be cut or otherwise formed in the desired shape. Preferably, the plates have through holes 41 to receive an end of the spacers Additionally, the plates that are in alignment with the axle 14 provide a through hole 43 to allow for the passage of the axle through a portion of the sculpture.

FIG. 19 shows the steps 1000 to design the sculpture. Determine the number of images to be cast by the sculpture 1002, make a sketch of the number of images 1004 with the correct orientation, select a suitable opaque solid to bound the sculpture 1006, enter the images in electronic form into the animation or CAD software 1008, using the animation or CAD software to determine the material that must be removed from the opaque solid to cast the first shadow 1008, repeat step 1008 for each number of shadows to be cast 1010, ensure that each shadow can be cast 1012, using the software to determine the shapes of each plate, the number of layers, the spacing between the plates 1014, form the plates into the desired shape 1016, and connect the plates together with the spacers 1018. Suitable software includes, for example, animation software such as MAYA obtained from Autodesk or LIGHTWAVE obtained from NewTek.

Figure 2:
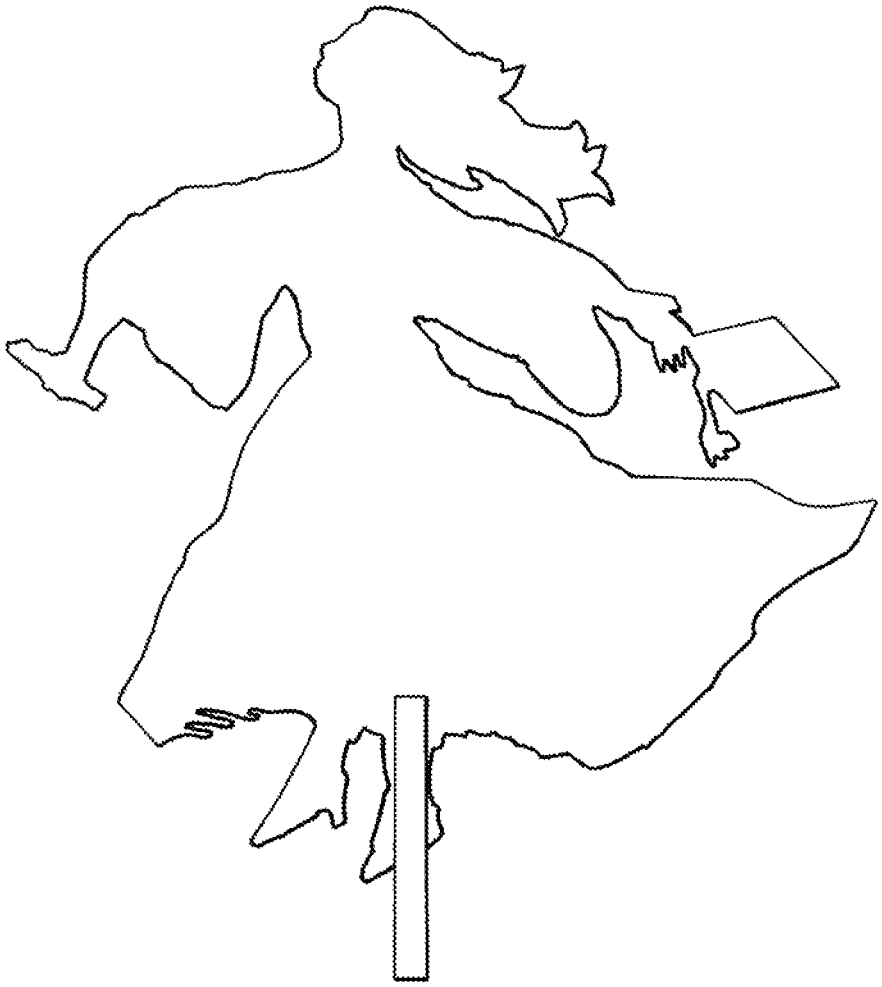
FIG. 2 is an elevation view of the sculpture from a first point of view.
Figure 3:
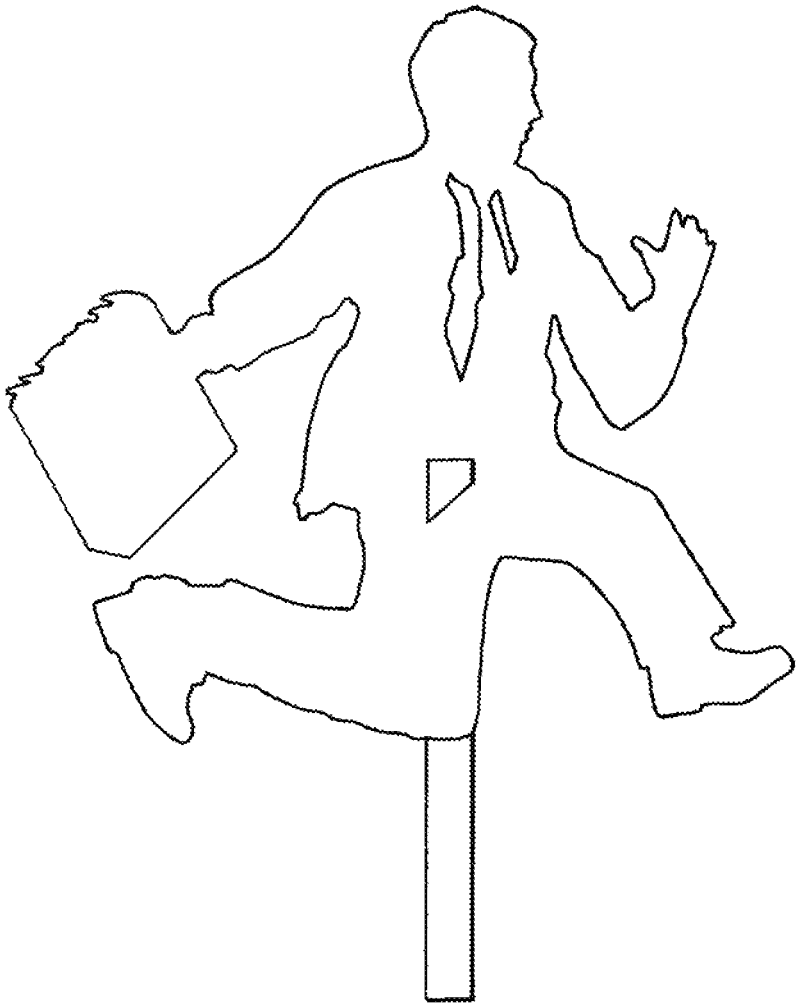
FIG. 3 is an elevation view of the sculpture from a second point of view.
Figure 4:
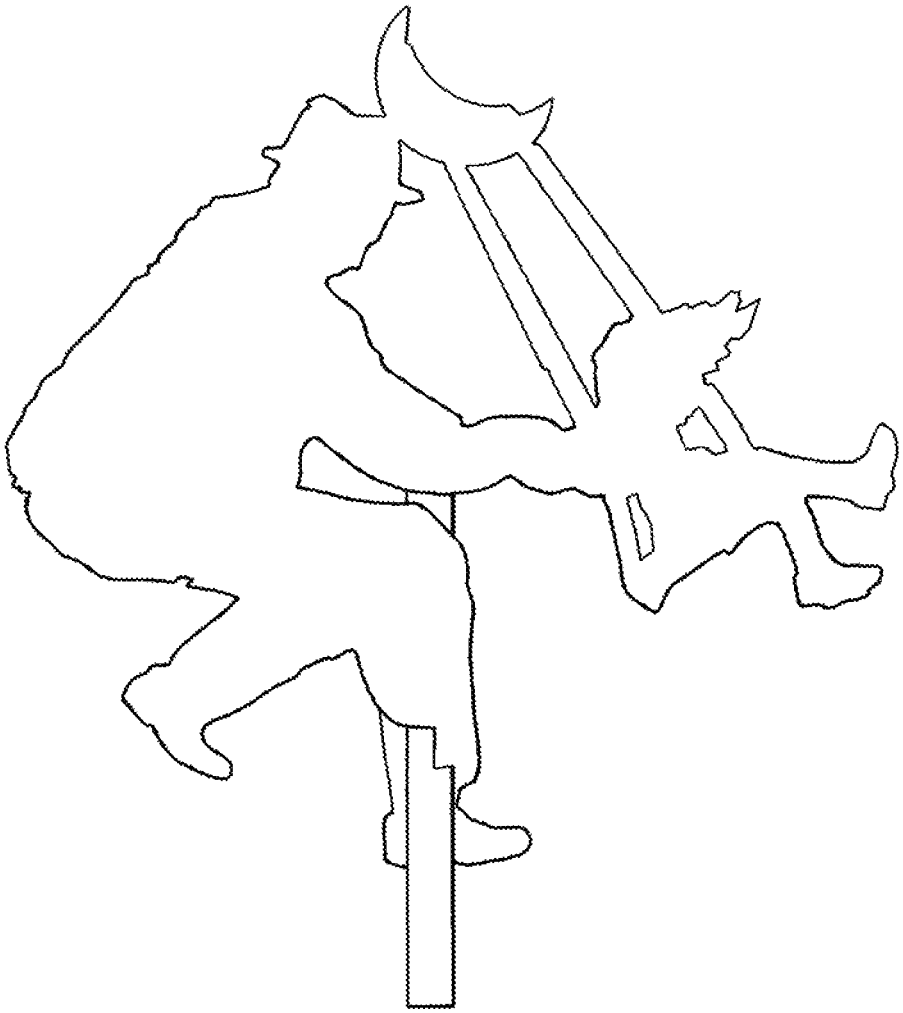
FIG. 4 is an elevation view of the sculpture from a third point of view.
Figure 5:
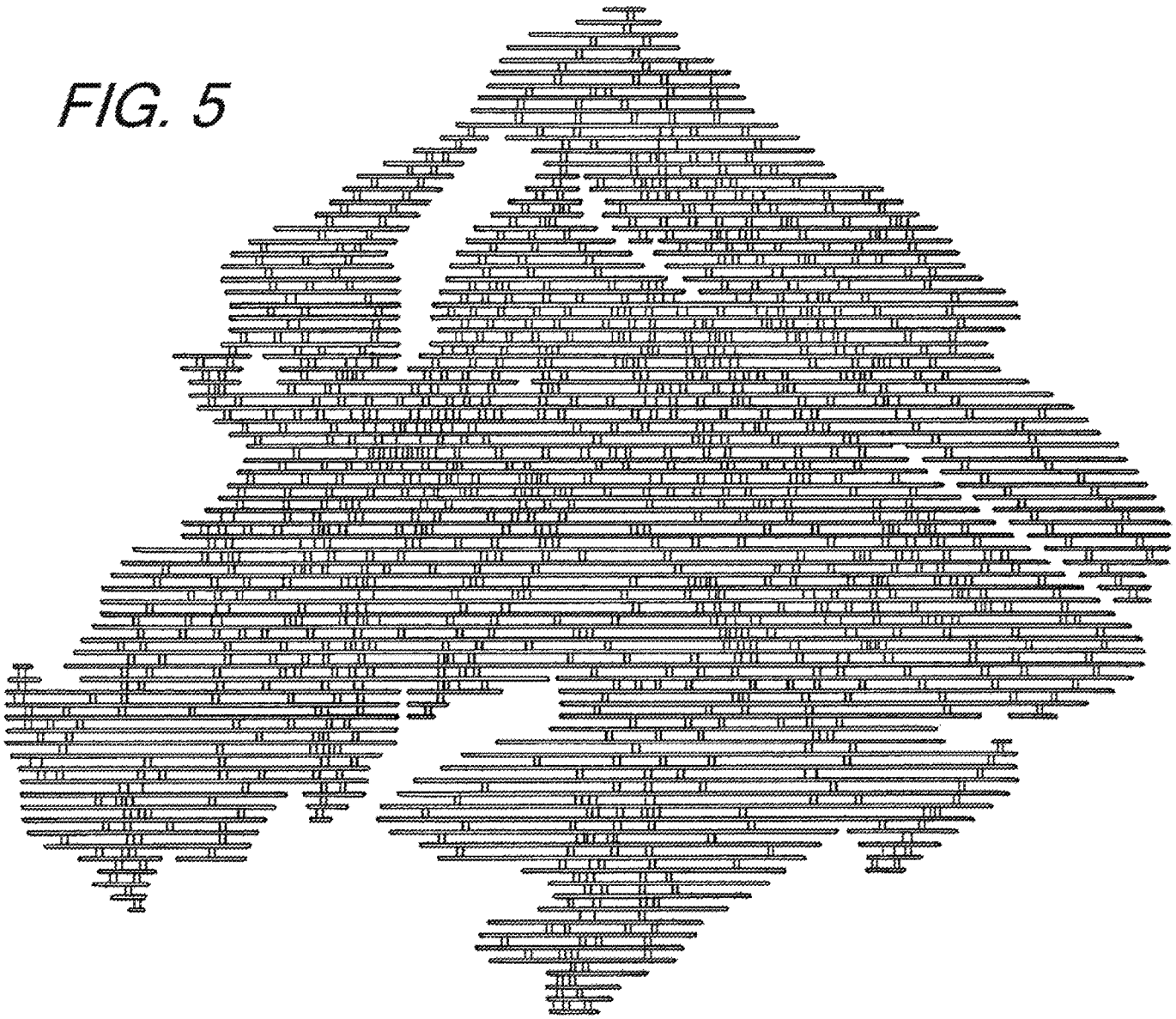
FIG. 5 is a back view of the sculpture.
Figure 6:
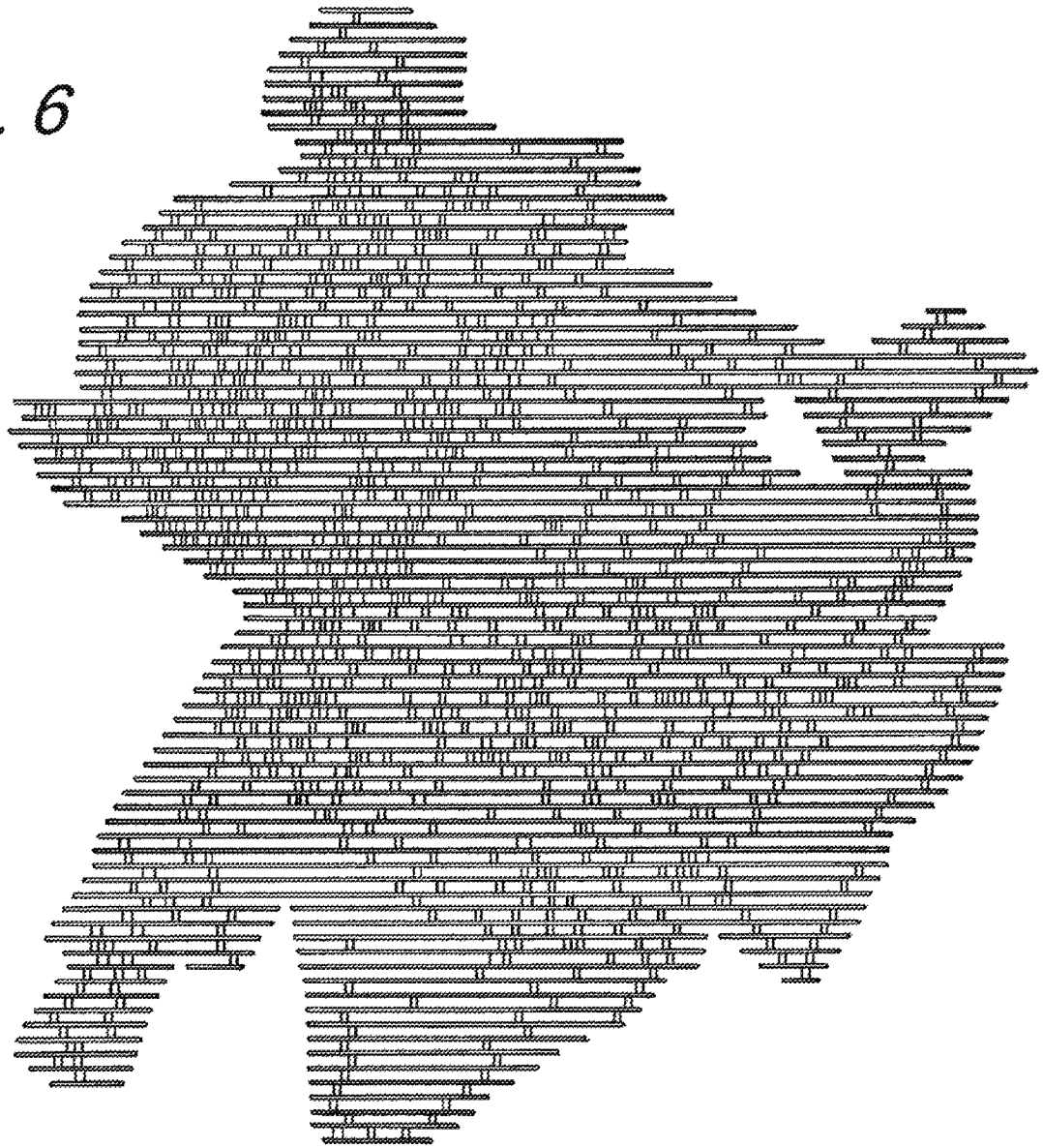
FIG. 6 is a right-side view of the sculpture.
Figure 7:
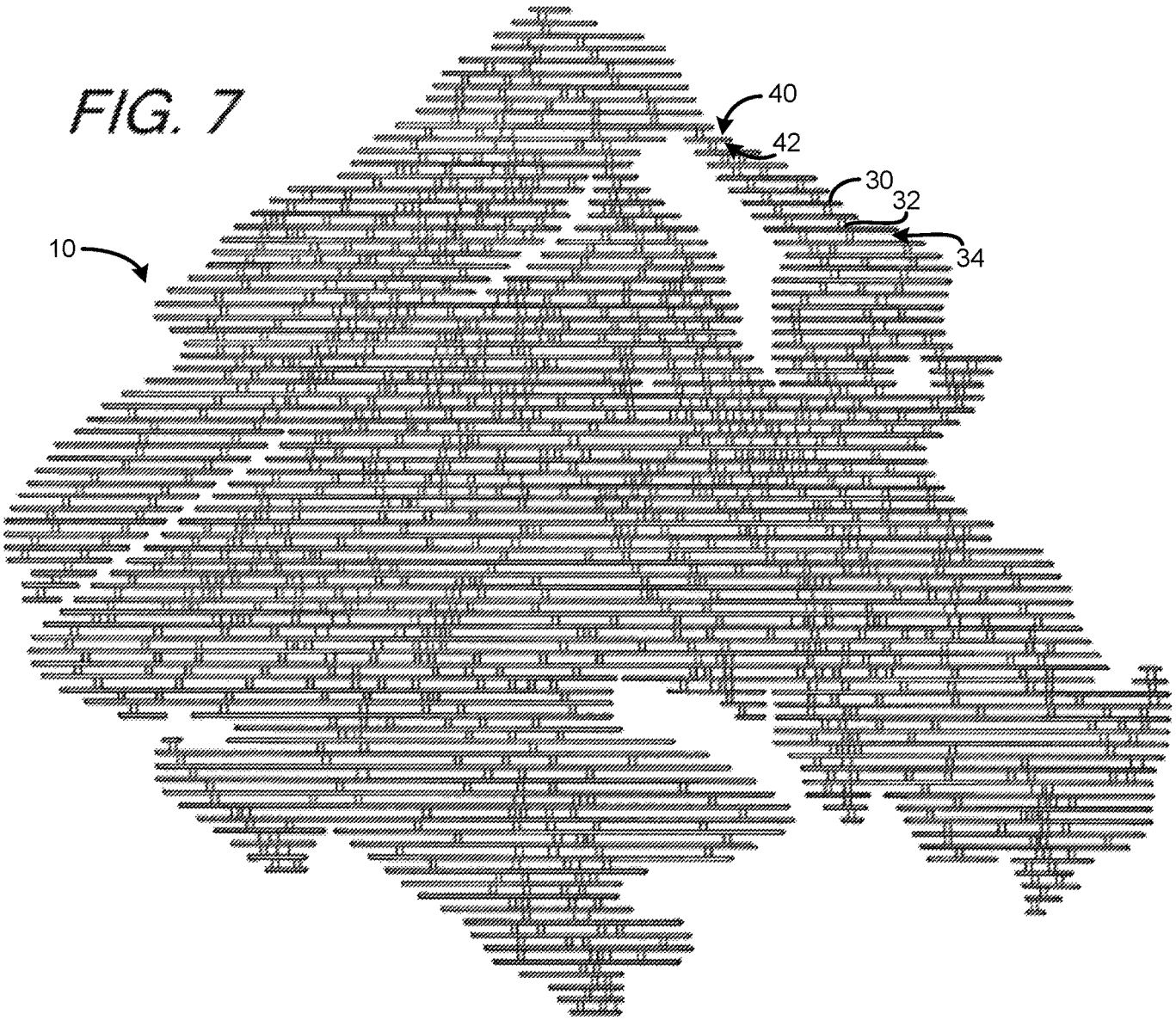
FIG. 7 is a front view of the sculpture.
Figure 8:
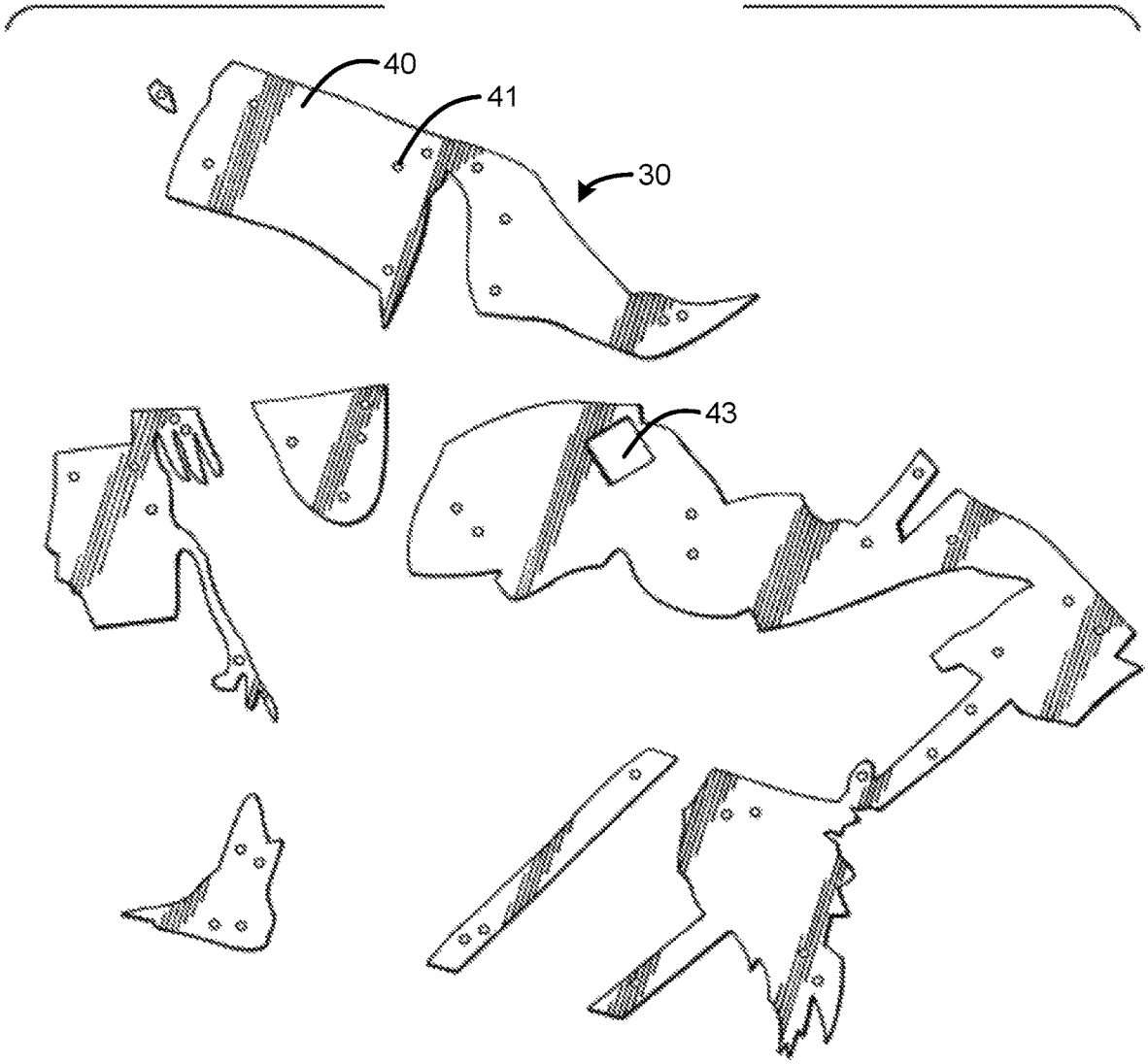
FIG. 8 is a cut-away view showing a side view of three levels of the sculpture.

To determine a suitable opaque solid, each shadow will require a pair of registered faces. To cast three shadows one needs at least three pairs of registered faces. In this description and drawings, a cube was selected as the opaque solid as it has three pairs of registered faces. Other opaque solids would work such as a rectangular cuboid, as well as many other of the polyhedra discussed above. For the sculpture shown in FIGS. 1-4, it was determined that the sculpture would cast three shadows, each shadow different from the others. Sketches were made of the desired shadows such as a graduate in a cap and gown with a diploma in hand (FIG. 2), a person in a business suit carrying a briefcase and on the run (FIG. 3), and a man pushing a child on a swing tethered to a crescent moon (FIG. 4). The three shadows were meant to sketch milestones in a person's life and to provoke thoughts of how the financial responsibilities at each life milestone changes as one matures from a graduate, through money-making years and into retirement.

The shadows are imported into a computer executing the software and are arranged by the software in the orthogonal planes XY, XZ, and YZ. Each is extruded so that the length of the extrusion is equal to the depth and height of the other two images. One then performs sequential intersection Boolean operations on the resulting shapes (or subtraction Boolean operations for negative space components). The resulting shape is tested to see if the sculpture will produce the desired shadows and will also produce a cohesive three-dimensional object that can be made as a real object. Very often it fails one of these two criteria. If it fails, the solid is analyzed to discover how the shadows can be adjusted in order to pass the test. This is an iterative process that will eventually produce the desired results without undue experimentation. The three sketches were optimized to pass the two physical tests.

Superfluous parts not connected to the main sculpture body that were created during the extrusion and Boolean operations are deleted. If the parts are connected through a section with insufficient strength to support all parts of the finished sculpture, then the shadows must be modified again such that the physical object will be robust. Any deleted parts must not be necessary for the desired shadows.

Each desired shadow image was drawn with a square palette template arranged with a point of the square at the base of the image and arranged so that all three shadows share the same point on the template. This action will ensure that each shadow will display upright on each subsequent rotation. In this example the resulting sculpture and images will have the axis positioned vertically through the sculpture and the light or viewer must be at the magic angle in order to reveal the hidden images. (Alternatively, with the square palette, one could opt for the shadows to share a common edge and the rotation axis would transverse the sculpture diagonally. In this scenario, the light source can enter vertically from above/below or four points horizontally while maintaining the magic angle with respect to the rotation axis.)

It may be desirable, but not necessary, to build a small version of the desired sculpture called a maquette. For example, a maquette can be carved or otherwise formed from a material such as wood, clay, plastic and the like. Before beginning the carving operation, one must first drill a hole at the magic angle through a block of wood from which the maquette is carved. For a cube-shaped block, the hole will pierce one corner of the cube, transverse through the cube's center and emerge from the opposite corner. This is known as the body diagonal. A specialized jig for holding the cube on a drill press table is recommended. The drill press must have a long throw and the quill must have a very small runout. These requirements will ensure an accurate hole necessary in the final sculpture.

When carving a sculpture, or maquette, one will find that the first shadow, by whatever subtractive method and with any material, will resemble a very deep puzzle piece. The top and bottom will be identical but mirror images of each other. It is possible to make one of the images slightly smaller than the image on the opposite face. In this case the light entering the sculpture should be from a point light source positioned at the focal length of the sculpture. The focal length can be determined by following the now slanted edge of the puzzle piece until the lines converge. This method will allow the shadow to be amplified. In all other cases, the shadows produced will be actual size of the sculpture and the light source should be as close as possible to the ideal distant light source with all photons on a parallel path through the sculpture.

As long as the shadow touches all four edges of the original square canvas (not always required) then the shadows of the two orthogonal faces will produce squares. These squares are the canvases of the other two shadows. One may devise a specialized jig to hold the sculpture while the other two shadows are carved in the block. Extreme care must be taken to protect any fragile components at all stages. The third carved image requires even more care. The maquette has been made as a proof of concept for the desired plate version, where the solid object is rendered not from a solid block of material but rather recreated from stacked plates of material. This operation is also modeled using the software mentioned above to ensure the proper layout.

Using such modeling software, the sculpture is digitally sliced, from a selected polyhedron, into a number of layers with a defined thickness, spacing, and geometry. Geometry, in the simplest case, is a plane extending to the edges of the bounding 3D polyhedron with a defined thickness. The thickness is based upon the desired materials for the eventual sculpture. The slices are then rendered on the computer to determine if the projected shadows have sufficient resolution. If there is not sufficient resolution to achieve the desired shadows, then the number of layers is increased and the spacing between layers is decreased until the shadows are complete. If there is sufficient resolution, then fewer layers with larger spacing are tested to evaluate the minimum number of plates that are necessary and sufficient.

The sculpture is then digitally assembled with the minimum number of spacers necessary to rigidly connect adjacent layers. Where a single spacer connects two layers, care must be taken to show alignment between the layers. Files are exported in the appropriate format in order to produce the required plate with defined geometry and holes for assembly.

When the sculpture is composed of a series of parallel plates cut through the original opaque solid and separated by the appropriate sized spacers, the directed light path 16 will strike the plates at an oblique angle and create the same shadow of the object as if it were still composed of a solid object. When viewed from the edge of the plates, the shadow of the sculpture itself effectively "disappears" because one only observes the edges of plates and the separation rods. In this case, the viewer is subject to the apparently impossible result: three distinct shadows are generated from a series of parallel plates. The stainless steel sculpture (titled "A Financial Life") comprises 79 layers (or slices through the opaque solid) 473 pieces ("plates"—with between one and thirteen plates per layer) and 1178 spacer rods. The exact number of layers, plates, and rods depends upon the complexity of the sculpture. Once the design is established, it is infinitely scalable.

Interestingly, each individual plate will bear little resemblance to any particular shadow. Even if one were to take slices parallel to the face of the polyhedra, there is no single slice that contains the complete shadow. By slicing perpendicularly to the angle $\alpha$ (~55 degrees in this embodiment), the individual plates take an even more abstract form. Since observers will first view the sculpture as a three-dimensional object, the interpretation will be of abstract forms. When illuminated or viewed from the correct angle, the two-dimensional representational forms will emerge, resulting in the "magical" transformation from abstract to representational.

The present invention also contemplates a kit for constructing a sculpture for casting shadows. The kit would include the plates, the spacers, and fasteners or adhesives to assemble the sculpture. The kit could also include a light source, a member for mounting the light source, and a member for mounting the sculpture for rotational movement about a desired axis or axes. The kit would also include instructions for assembling the sculpture and for using the sculpture to cast shadows.

3D Printing

Within the field of 3D printing, one is always interested in optimizing the use of time and print media. Most (if not all) 3D printers endorse the idea of making the printed model hollow in order to save time and materials. Alternatively, one could use the plate method to produce a model that preserves all of the fundamental features of the geometry with a fraction of the amount of materials. This translates into a proportional timesaving to produce a 3D print. In the case of my "A Financial Life" sculpture, I have reduced the amount of stainless steel used in the project by 75%.

Additional shadows can be formed by attaching plates to an outer edge of the sculpture transverse to the other plates. If added, these plates would create additional shadows (or images) but at the expense of the sculpture "disappearing" when viewed on edge.

The present invention also provides a mechanism for rotating the sculpture about one or more axes of rotation. While an axle is shown as a mechanism for rotating the sculpture, other methods of mounting the sculpture for rotational motion about an axis are contemplated.

While spacers are shown connecting plates, it is contemplated that the plates could be mounted on a rack or frame that has an array of connectors for receiving plates. The plates can be releasably connected to the rack or frame so that changes to the sculpture can be made with ease.

It is also contemplated the sculpture can be supported by strings, rope, cables or the like and can be moveable from a stowed position to a display position. In the stowed position, the plates are stacked on top of one another in a flattened structure. The sculpture can be erected by pulling on the supporting strings to move the plates to form gaps between the plates to place the sculpture in a display condition for casting shadows. The sculpture can be lowered into the collapsed form before rotation so that the transformation is more dramatic.

Many modifications and variations of the present invention are possible in light of the above teachings. It is, therefore, to be understood within the scope of the appended claims the invention may be protected otherwise than as specifically described.

I claim:

1. A sculpture bound within a volume of a polyhedron having a first plurality of pairs of registered faces comprising:

a first plurality of plates connected together in parallel spaced relationship with a plurality of spacers, the plurality of spacers formed in a process other than a process that formed the first plurality of plates, to form a first number of layers with gaps between adjacent plates, the first plurality of plates having surfaces extending transverse to a first pair of registered faces of the first plurality of pairs of registered faces and arranged to cast a first shadow of a predetermined shape when the sculpture is positioned at a first angle of rotation about an axis and in a light path of a source of light directed at an oblique angle to the surfaces;

a second plurality of plates connected together in parallel spaced relationship with a plurality of spacers, the plurality of spacers formed in a process other than a process that formed the second plurality of plates, to form a second number of layers with gaps between adjacent plates, the second plurality of plates having surfaces extending transverse to a second pair of registered faces of the first plurality of registered faces and arranged to cast a second shadow of a predetermined shape when the sculpture is positioned at a second angle of rotation about the axis different from the first angle and in the light path directed at an oblique angle to the surfaces; and, a member connected to the sculpture with the axis of rotation extending through the member and rotation of the member successively brings each pair of registered faces of the first plurality of pairs of registered faces into alignment with the light path.

2. The sculpture of claim 1 further comprising a third plurality of plates connected together in parallel spaced relationship with a plurality of spacers, the plurality of spacers formed in a process other than a process that formed the third plurality of plates, to form a third number of layers with gaps between adjacent plates, the third plurality of plates having surfaces extending transverse to a third pair of registered faces of the first plurality of pairs of registered faces and arranged to cast a third shadow of a predetermined shape when the sculpture is positioned at a third angle of rotation about the axis and in the light path directed at an oblique angle to the surfaces, the third angle being different from the first angle and the second angle.

3. The system of claim 1 wherein each of the plurality of spacers has opposed ends with one of each opposed end being connected to a different plate of a pair of adjacent plates to connect the pair of adjacent plates.

4. The sculpture of claim 1 wherein the polyhedron is a platonic solid, an Archimedian solid, a Johnson solid, a parallelpiped, a polygonal prism, or a polygonal antiprism.

5. The sculpture of claim 4 wherein the polygonal prism and the polygonal antiprism have polygonal faces where the polygon is selected from the group consisting of a triangle, a square, a rectangle, a pentagon, a hexagon, a heptagon, and a octagon.

6. The sculpture of claim 5 wherein the polygon is a regular polygon.

7. The sculpture of claim 4 wherein the platonic solid is a tetrahedron, a cube, an octahedron, a dodecahedron or an icosahedron.

8. The sculpture of claim 4 wherein the Archimedian solid is a cuboctahedron.

9. The sculpture of claim 1 wherein the first plurality of plates are parallel to the second plurality of plates.

10. The sculpture of claim 1 wherein a portion of the plates of the first plurality of plates have planar surface.

11. The sculpture of claim 1 wherein a portion of the plates of the first plurality of plates have curved cross-sectional shapes.

12. The sculpture of claim 1 further comprising a second plurality of pairs of registered faces and a second axis of rotation disposed at a fourth angle to the first axis of rotation, wherein rotation of the sculpture about the second axis successively brings each pair of registered faces of the second plurality of pairs of registered faces into alignment with the light path.

13. The sculpture of claim 12 wherein the polyhedron has a plurality of polar faces disposed about the first axis and a plurality of equatorial faces disposed about the second axis.

14. The sculpture of claim 1 wherein each of the first plurality of registered faces comprises a first polygon having a first set of vertices and a first set of edges, a second polygon with a second set of vertices and a second set of edges, wherein first set of vertices are in registration with the second set of vertices to form a prism, or the first set of vertices are in registration with the second set of edges to form an anti-prism.

15. The sculpture of claim 14 wherein the first set of vertices is equal to the second set of vertices.

16. A system for projecting multiple silhouettes on to a surface comprising:

a sculpture bound within a volume of a polyhedron having a first plurality of pairs of registered faces comprising:

a first plurality of plates connected together in parallel spaced relationship with a plurality of spacers, the plurality of spacers formed in a process other than a process that formed the first plurality of plates, to form a first number of layers with gaps between adjacent plates, the first plurality of plates having surfaces extending transverse to a first pair of registered faces of the first plurality of pairs of registered faces and arranged to cast a first shadow of a predetermined shape when the sculpture is positioned at a first angle of rotation about an axis and in a light path of a source of light directed at an oblique angle to the surfaces;

a second plurality of plates connected together in parallel spaced relationship with a plurality of spacers, the plurality of spacers formed in a process other than a process that formed the second plurality of plates, to form a second number of layers with gaps between adjacent plates, the second plurality of plates having surfaces extending transverse to a second pair of registered faces of the first plurality of registered faces and arranged to cast a second shadow of a predetermined shape when the sculpture is positioned at a second angle of rotation about the axis different from the first angle and in the light path directed at an oblique angle to the surfaces; and an axle connected to the sculpture with the axis of rotation extending through the axle and rotation of the axle successively brings each pair of registered faces of the first plurality of pairs of registered faces into alignment with the light path; and, the light source mounted proximate the sculpture.

17. The system of claim 16 further comprising a third plurality of plates connected together in parallel spaced relationship with a plurality of spacers, the plurality of spacers formed in a process other than a process that formed the third plurality of plates, to form a third number of layers with gaps between adjacent plates, the third plurality of plates having surfaces extending transverse to a third pair of registered faces of the first plurality of pairs of registered faces and arranged to cast a third shadow of a predetermined shape when the sculpture is positioned at a third angle of rotation about the axis and in the light path directed at an oblique angle to the surfaces, the third angle being different from the first angle and the second angle.

18. The sculpture of claim 17 wherein the polyhedron is a platonic solid, an Archimedian solid, a Johnson solid, a parallelpiped, a polygonal prism, or a polygonal antiprism.

19. The system of claim 18 wherein the polygonal prism and the polygonal antiprism have polygonal faces where the polygon is selected from the group consisting of a triangle, a square, a rectangle, a pentagon, a hexagon, a heptagon, and a octagon.

20. The system of claim 16 wherein the plurality of spacers has opposed ends with one of each opposed end being connected to a different plate of a pair of adjacent plates to connect the pair of adjacent plates.

* * * * *